US010856625B1

(12) United States Patent
Weng et al.

(10) Patent No.: US 10,856,625 B1
(45) Date of Patent: Dec. 8, 2020

(54) BELT BUCKLE WITH RAPID FASTENING ARRANGEMENT

(71) Applicant: Landmark International Group Inc, San Dimas, CA (US)

(72) Inventors: Guoku Weng, Glendora, CA (US); Zhibin Cai, Shishi (CN)

( * ) Notice: Subject to any disclaimer, the term of this patent is extended or adjusted under 35 U.S.C. 154(b) by 0 days.

(21) Appl. No.: 16/922,994

(22) Filed: Jul. 7, 2020

(30) Foreign Application Priority Data

May 21, 2020 (CN) ..... 2020 2 0867409 U

(51) Int. Cl.
*A44B 11/00* (2006.01)
*A44B 11/06* (2006.01)
*A44B 11/25* (2006.01)

(52) U.S. Cl.
CPC ..... *A44B 11/06* (2013.01); *A44B 11/006* (2013.01); *A44B 11/2542* (2013.01)

(58) Field of Classification Search
CPC ... A44B 11/2542; A44B 11/006; A44B 11/06; A44B 11/008; A41F 9/002
See application file for complete search history.

(56) References Cited

U.S. PATENT DOCUMENTS 2,629,104 A * 2/1953 Easlick ..... A44B 11/008 2/322
2,630,612 A * 3/1953 Stark ..... A44B 11/24 24/178
4,406,043 A * 9/1983 Friedman ..... A44B 11/006 24/171
4,581,791 A * 4/1986 Ong ..... A44B 11/001 24/163 K
6,711,785 B1 * 3/2004 Hicks ..... A44B 11/006 24/3.1
8,302,266 B2 * 11/2012 Chen ..... A44B 11/001 24/163 K
2003/0033697 A1 * 2/2003 Hicks ..... A44B 11/266 24/615
2003/0182777 A1 * 10/2003 Kim ..... A44B 11/266 24/615
2005/0217080 A1 * 10/2005 Kojoori ..... A44C 5/14 24/265 WS
2014/0007388 A1 * 1/2014 Hartnell ..... A44B 11/2542 24/633
2014/0230202 A1 * 8/2014 Humbert ..... A44B 11/253 24/640
2016/0021985 A1 * 1/2016 Liu ..... A44B 11/006 2/322

(Continued)

*Primary Examiner* — Jason W San
(74) *Attorney, Agent, or Firm* — Tsz Lung Yeung

(57) ABSTRACT

A belt buckle for includes a base frame, a connector housing movably attached on the base frame, and a rapid fastening arrangement. The rapid fastening arrangement includes a first fastening member extended from the base frame, a second fastening member also extended from the base frame, a holding bridge defining a through securing slot, a biasing member, and a resilient assembly. The resilient assembly is arranged to exert an urging force toward the biasing member, in such a manner that when a fastening end portion of the belt strap is received in the through securing slot, the resilient assembly is arranged to drive the biasing member, the first fastening member and the second fastening member to bias against the belt strap so as to securely fasten the fastening end portion on the belt strap.

14 Claims, 9 Drawing Sheets

(56) References Cited

U.S. PATENT DOCUMENTS

| | | | | |
|---|---|---|---|---|
| 2017/0020234 | A1* | 1/2017 | Taylor | A44B 11/005 |
| 2019/0159554 | A1* | 5/2019 | Mouquet | A44B 11/22 |
| 2019/0387843 | A1* | 12/2019 | Wang | A44B 11/006 |

* cited by examiner

BELT BUCKLE WITH RAPID FASTENING ARRANGEMENT

CROSS REFERENCE TO RELATED APPLICATION

This is a non-provisional application which claims priority to a Chinese patent application having an application number of CN 202020867409.4, and a filing date of May 21, 2020, the entire contents of which is hereby incorporated by reference.

BACKGROUND

Field of Invention

The present invention relates to a buckle, and more particularly to a belt buckle comprising a rapid fastening arrangement which is capable of allowing a user to rapidly mount a belt strap on the belt buckle without needing to form fastening holes thereon.

Description of Related Arts

A conventional belt usually comprises a belt strap having a fastening end portion and a connecting end portion, and a belt buckle attached on the connecting end portion of the belt strap for detachably fastening the belt strap on a wearer's body. Conventionally, the belt buckle may comprise a main frame having a through cavity formed thereon, and a fastening pin extended from the main frame along a longitudinal direction of the belt strap. The belt strap has a plurality of fastening holes formed on the fastening end portion. When in use, the fastening end portion is arranged to penetrate through the through cavity while the fastening pin may penetrate through one of the fastening holes for fastening the fastening portion on the belt buckle. As such, the fastening end portion is prevented from detaching from the belt buckle.

A major disadvantage of the conventional belt such as the one described above is the use of fastening holes on the fastening end portion for fastening the belt buckle with the belt strap. First, the production of the through fastening holes on the belt strap is permanent. When the holes are wrongly punched, belt strap cannot be used for fastening on a wearer's body. Moreover, when too less fastening holes are punched on the fastening end portion, a wearer may need to add additional holes on the belt strap. This create much troublesome to the wearer as well as the seller. Conversely, when too many fastening holes are formed on the fastening end portion, they will severely affect the overall aesthetical appearance of the belt.

As a result, there is a need to develop a belt which does not require fastening holes for fastening the belt strap on the wearer's body.

SUMMARY OF THE PRESENT INVENTION

Implementations of the present disclosure provide a belt buckle comprising a rapid fastening arrangement which is capable of allowing a user to rapidly mount a belt strap on the belt buckle without needing to form fastening holes thereon.

Implementations of the present disclosure provide a belt buckle comprising a connector housing which is capable of rotating with respect to a base frame so as to allow a user to selectively expose either one surface of a belt strap. In other words, a wearer of the present invention may select which surface to be exposed to others for aesthetic purpose.

In one aspect of the present invention, it provides a belt, comprising:

a belt strap having a connecting end portion and a fastening end portion;

a belt buckle, which comprises:

a base frame;

a connector housing movably attached on the base frame, the connecting housing having a connecting cavity for detachably receiving the connecting end portion of the belt strap; and a rapid fastening arrangement, which comprises:

a first fastening member extended from the base frame;

a second fastening member extended above the first fastening member, at least one of the first fastening member and the second fastening member being arranged to be pivotally movable with respect to the base frame so as to form a fastening slot as a space between the first fastening member and the second fastening member for receiving the fastening end portion of the belt strap;

a holding bridge extended from the base frame and having a through securing slot;

a biasing member pivotally supported in the through securing slot; and a resilient assembly mounted on the base frame and exert an urging force toward the biasing member, in such a manner that when the fastening end portion of the belt strap is received in the through securing slot, the resilient assembly is arranged to drive the biasing member, the first fastening member and the second fastening member to bias against the belt strap so as to securely fasten the fastening end portion on the belt strap.

In another aspect of the present invention, it provides a belt buckle for a belt strap having a connecting end portion and a fastening end portion, comprising:

a base frame;

a connector housing movably attached on the base frame, the connecting housing having a connecting cavity for detachably receiving the connecting end portion of the belt strap; and a rapid fastening arrangement, which comprises:

a first fastening member extended from the base frame;

a second fastening member extended above the first fastening member, at least one of the first fastening member and the second fastening member being arranged to be pivotally movable with respect to the base frame so as to form a fastening slot as a space between the first fastening member and the second fastening member for receiving the fastening end portion of the belt strap;

a holding bridge extended from the base frame and having a through securing slot;

a biasing member pivotally supported in the through securing slot; and a resilient assembly mounted on the base frame and exert an urging force toward the biasing member, in such a manner that when the fastening end portion of the belt strap is received in the through securing slot, the resilient assembly is arranged to drive the biasing member, the first fastening member and the second fastening member to bias against the belt strap so as to securely fasten the fastening end portion on the belt strap.

This summary presented above is provided merely to introduce certain concepts and not to identify any key or essential features of the claimed subject matter.

DETAILED DESCRIPTION OF THE PREFERRED EMBODIMENT

Figure 1:
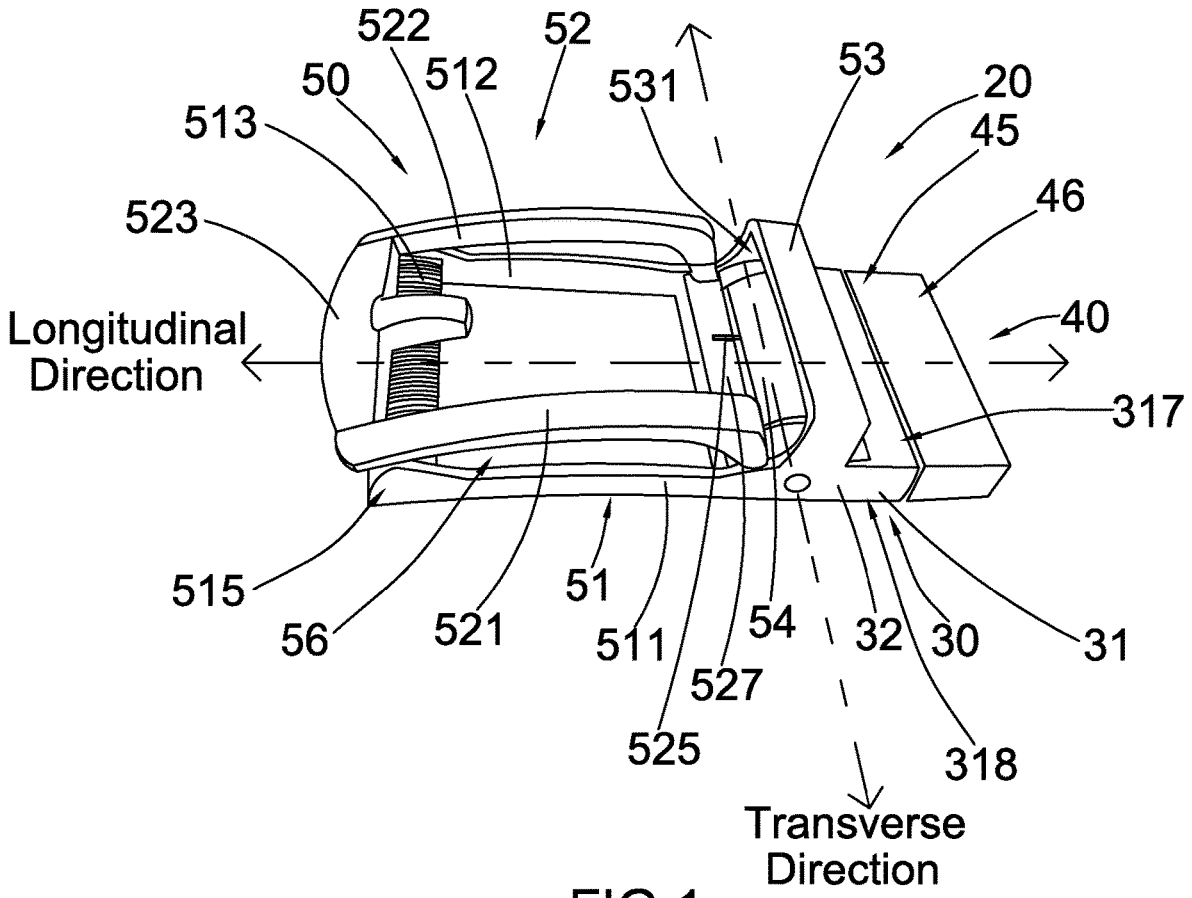
FIG. 1 is a perspective view of a belt buckle according to a preferred embodiment of the present invention.
Figure 2:
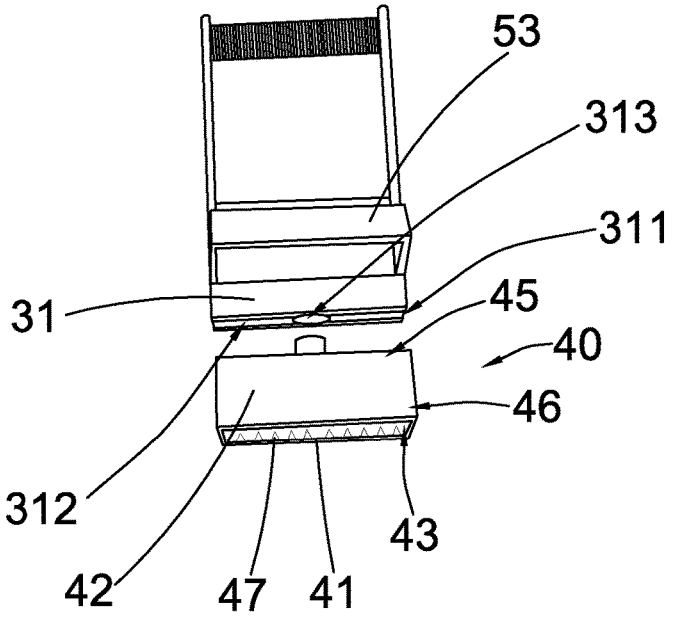
FIG. 2 is a partially exploded view of the belt buckle according to the preferred embodiment of the present invention, illustrating a base frame, a first fastening member and a connector housing.
Figure 3:
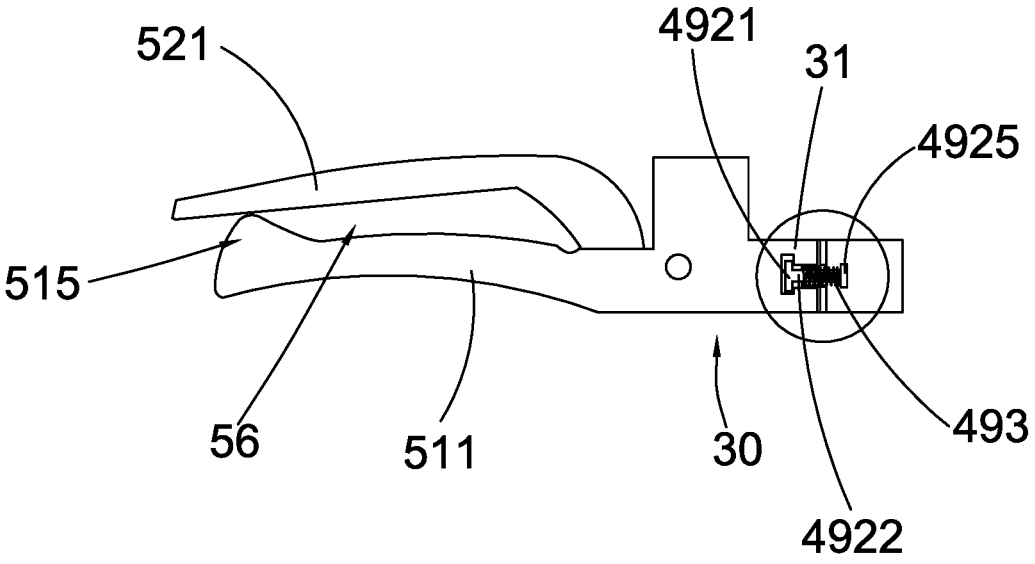
FIG. 3 is side schematic view of the belt buckle according to the preferred embodiment of the present invention.
Figure 4:
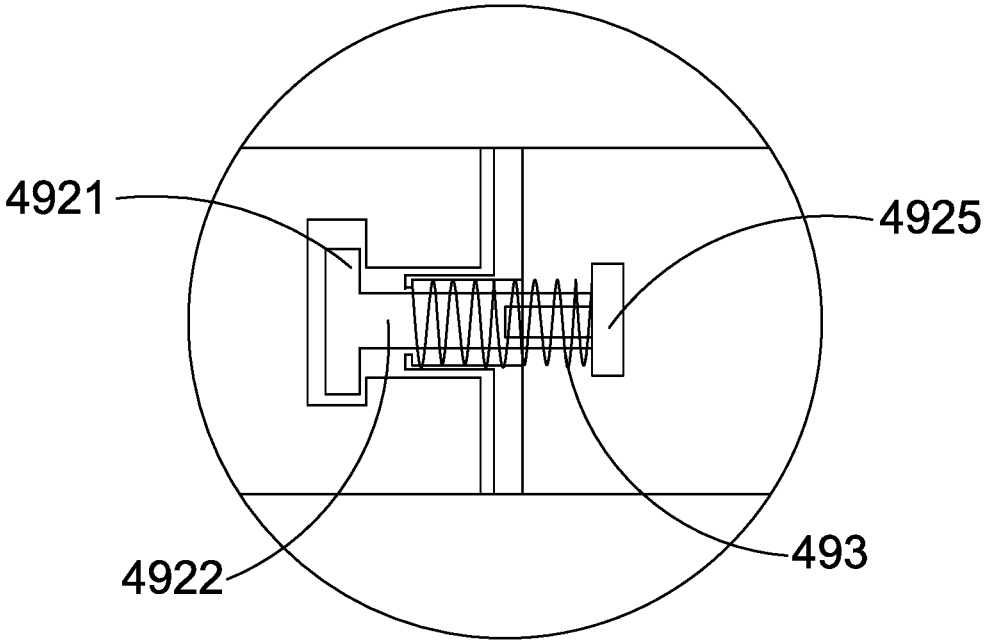
FIG. 4 is another side schematic view of the belt buckle according to the preferred embodiment of the present invention, illustrating connection between a connector housing and a base frame.
Figure 5:
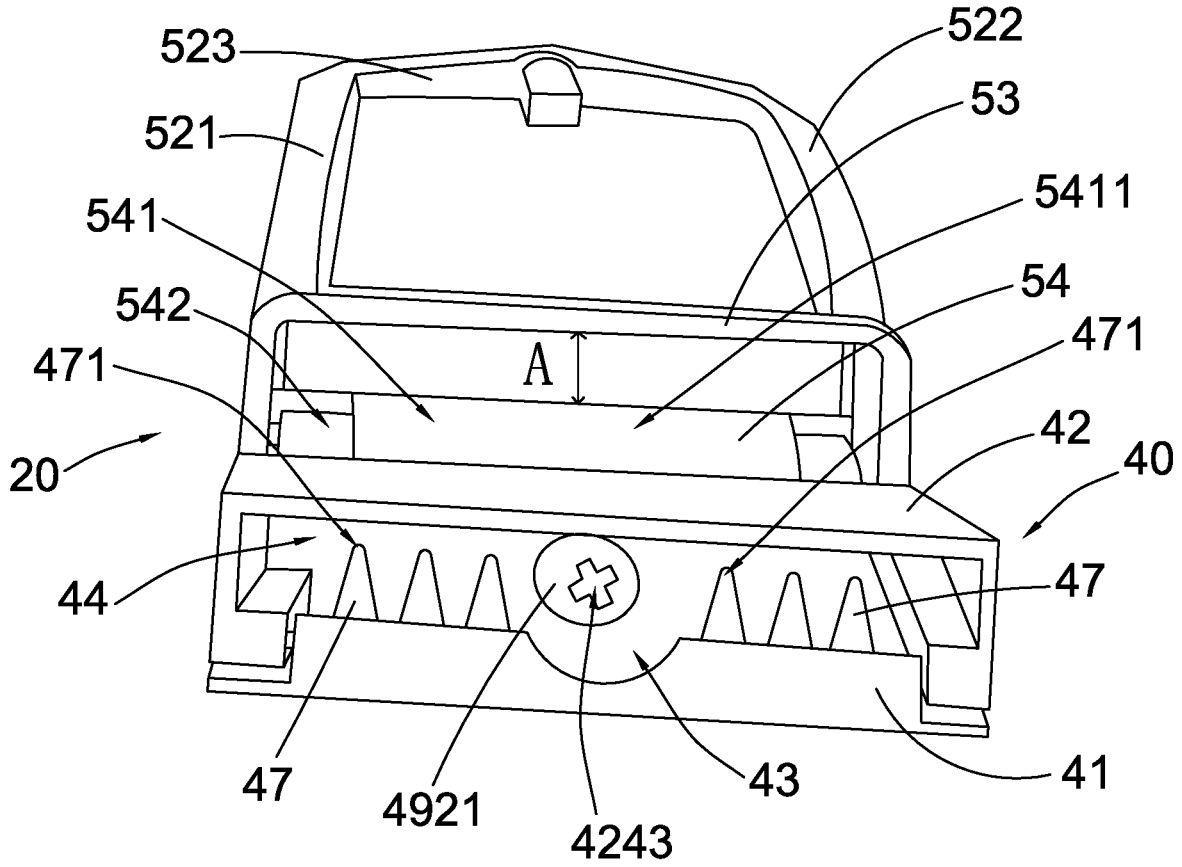
FIG. 5 is a perspective view of the belt buckle according to the preferred embodiment of the present invention.
Figure 6:
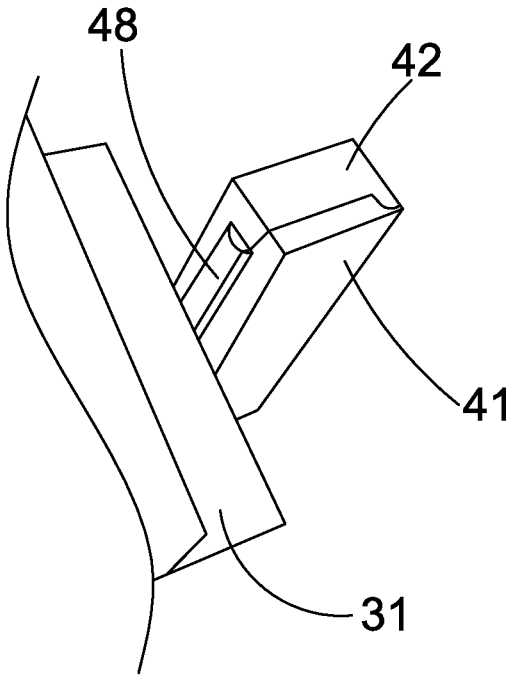
FIG. 6 is a schematic view of the belt buckle according to the preferred embodiment of the present invention, illustrating that the connector housing is rotated with respect to the base frame.
Figure 7:
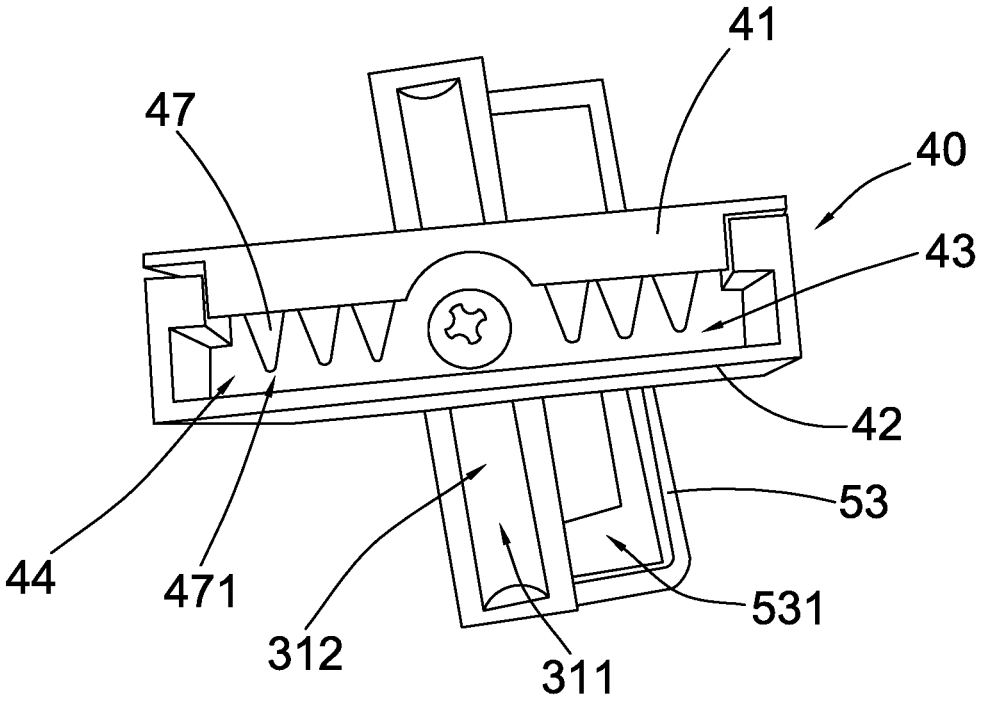
FIG. 7 is another schematic view of the belt buckle according to the preferred embodiment of the present invention, illustrating that the connector housing is being rotated with respect to the base frame.
Figure 8:
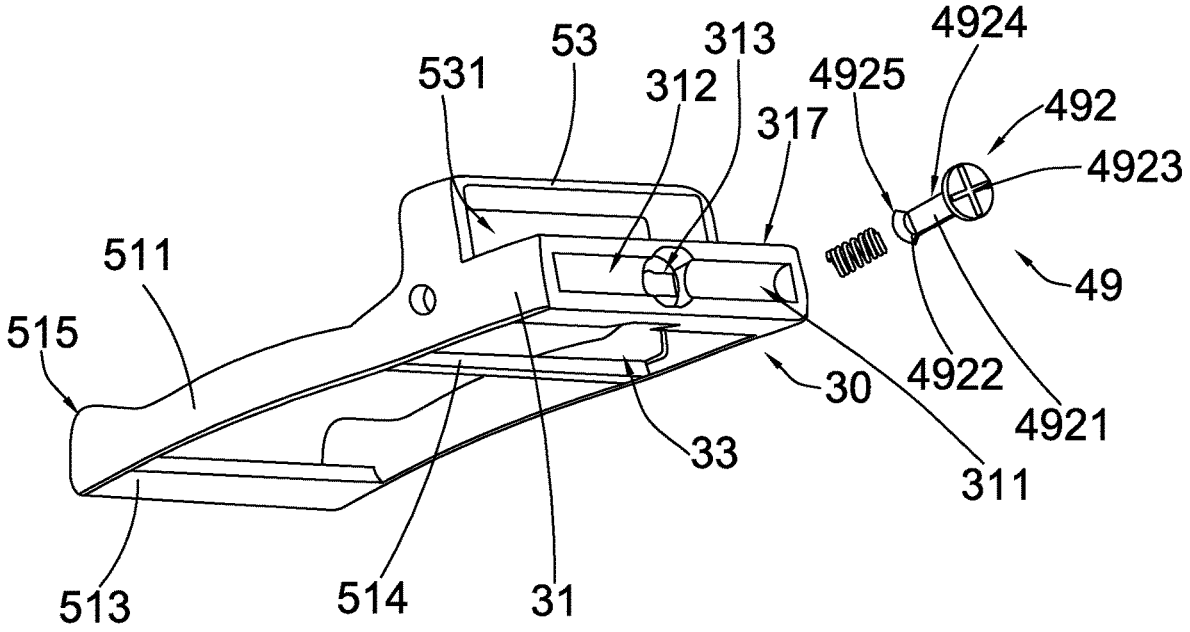
FIG. 8 is a rear perspective view of the belt buckle according to the preferred embodiment of the present invention.

The following detailed description of the embodiments is the preferred mode of carrying out the present disclosure. The description is not to be taken in any limiting sense. It is presented for the purpose of illustrating the general principles of embodiments of the present disclosure.

It should be appreciated that the terms "install", "connect", "couple", and "mount" in the following description refer to the connecting relationship in the accompanying drawings for easy understanding of embodiments of the present disclosure. For example, the connection can refer to permanent connection or detachable connection. Furthermore, "connected" may also mean direct connection or indirect connection, or connection through other auxiliary components. Therefore, the above terms should not be an actual connection limitation of the elements of embodiments of the present disclosure.

It should be appreciated that the terms "length", "width", "top", "bottom", "front", "rear", "left", "right", vertical", "horizontal", "upper", "lower", "exterior", and "interior" in the following description refer to the orientation or positioning relationship in the accompanying drawings for easy understanding of embodiments of the present disclosure without limiting the actual location or orientation of embodiments of the present disclosure. Therefore, the above terms should not be an actual location limitation of the elements of embodiments of the present disclosure.

It should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of embodiments of the present disclosure.

Referring to FIG. 1 to FIG. 13 of the drawings, a belt according to a preferred embodiment of the present invention is illustrated. Broadly, the belt may comprise a belt strap 10 having a connecting end portion 11 and a fastening end portion 12, and a belt buckle 20.

The belt buckle 20 may comprise a base frame 30, a connector housing 40 and a rapid fastening arrangement 50. The connector housing 40 may be movably attached on the base frame 30. The connecting housing 40 may have a connecting cavity 43 for detachably receiving the connecting end portion 11 of the belt strap 10.

The rapid fastening arrangement 50 may comprise a first fastening member 51, a second fastening member 52, a holding bridge 53, a biasing member 54, and a resilient assembly 55. The first fastening member 51 may extend from the base frame 30.

The second fastening member 52 may extend above the first fastening member 51, wherein at least one of the first fastening member 51 and the second fastening member 52 may be arranged to be pivotally movable with respect to the base frame 30 so as to form a fastening slot 56 as a space between the first fastening member 51 and the second fastening member 52 for receiving the fastening end portion 12 of the belt strap 10.

The holding bridge 53 may extend from the base frame 30 and may have a through securing slot 531. The biasing member 53 may be pivotally supported in the through securing slot 531.

The resilient assembly 55 may be mounted on the base frame 30 and may be arranged to exert an urging force toward the biasing member 53, in such a manner that when the fastening end portion 12 of the belt strap 10 is received in the through securing slot 531, the resilient assembly 55 may be arranged to drive the biasing member 53, the first fastening member 51 and the second fastening member 52 to bias against the belt strap 10 so as to securely fasten the fastening end portion 12 on the belt strap 10.

According to the preferred embodiment of the present invention, the buckle strap 10 may be elongated in structure and may be configured from fabric, leather, plastic or other composite materials. The buckle strap 10 may be arranged to wear on a wearer's body. The connecting end portion 11 and the fastening end portion 12 may represent two end portions of the elongated buckle strap 10 respectively.

The base frame 30 may comprise a frame housing 31 having a connecting portion 317 and an opposed fastening portion 318. The fastening portion 318 and the connecting portion 317 may customarily represent a front side and a rear side of the frame housing 31 respectively. The base frame 30 may further comprise two extension members 32 extended from the fastening portion 318 of the frame housing 31 to form an accommodation cavity 33 as the space between the two extension members 32.

Moreover, the frame housing 31 may have a mounting slot 311 indently formed on the connecting portion 317 of the frame housing 31 but along a transverse direction thereof, wherein the connector housing 40 may be movably coupled to the connecting portion 317 of the frame housing 31 through the mounting slot 311. The mounting slot 311 may be surrounded by a curved boundary wall 312.

Furthermore, the frame housing 31 may further have a through mounting hole 313 formed on the curved boundary wall 312 of the mounting slot 311 and extend along a longitudinal axis of the belt buckle 20. The mounting hole 313 may penetrate the curved boundary wall 312 of the mounting slot 311 for coupling with the connector housing 40 (described in more details below).

In addition, the frame housing 31 may have a front wall 315 and a through locking hole 316 formed on the front wall 315, wherein the front wall 315 may extend along a transverse direction of the belt buckle 20 and may be positioned opposite to the mounting slot 311. On the other hand, the through locking hole 316 may extend along a longitudinal direction of the belt buckle 20 and may communicate with the through mounting hole 313. The through mounting hole 313 and the through locking hole 316, however, may have different cross-sectional shape.

Figure 9:
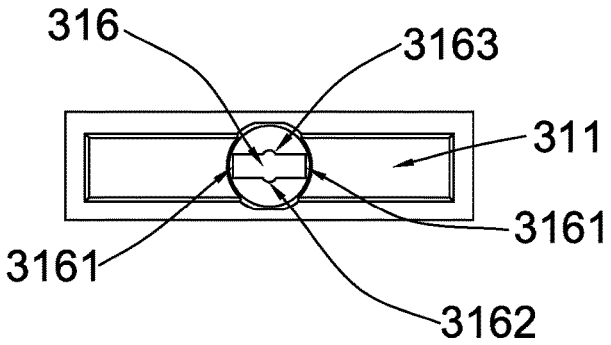
FIG. 9 is a rear view of a frame housing of the belt buckle according to the preferred embodiment of the present invention.
Figure 10:
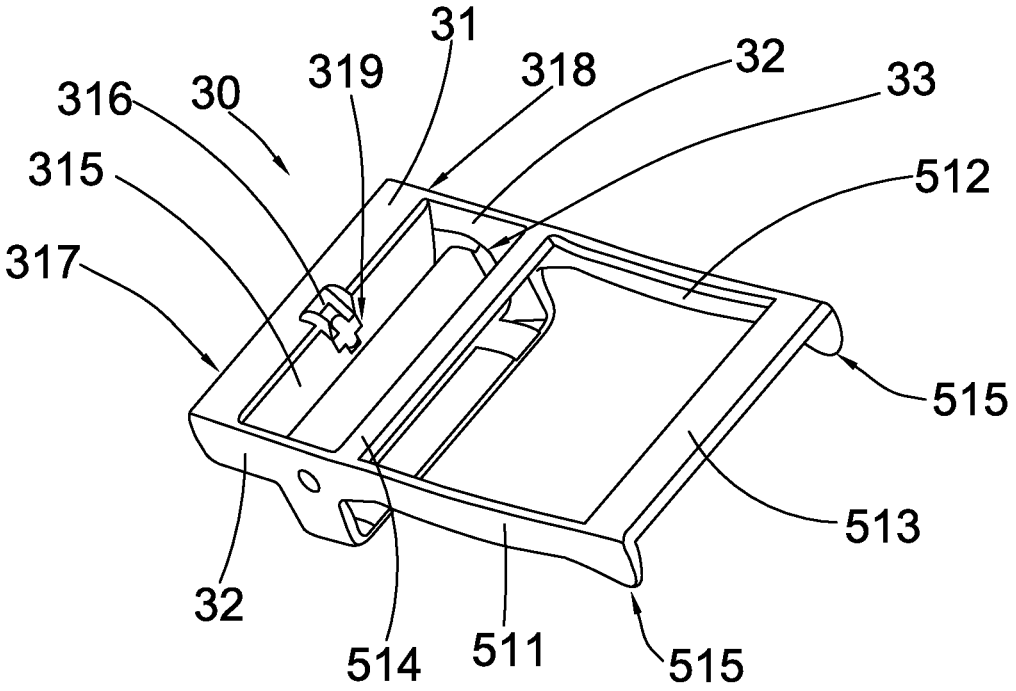
FIG. 10 is another perspective view of a base frame and a first fastening member of the belt buckle according to the preferred embodiment of the present invention.

As shown in FIG. 9 and FIG. 10 of the drawings, the through mounting hole 313 may have a circular cross-sectional shape when viewed from the rear (as in FIG. 9) while the through locking hole 316 may have a non-circular cross-sectional shape when viewed from the front (as in FIG. 10). Specifically, the through locking hole 316 may have an elongated shape or a quadrilateral-like cross-sectional shape. As illustrated in FIG. 10 of the drawings, the through locking hole 316 may be formed by two vertical side edges 3161, a curved top edge 3162 and a curved bottom edge 3163. The through locking hole 316 may communicate with the through mounting slot 311. A maximum vertical height of locking hole 316 may be smaller than a width thereof.

On the other hand, the connector housing 40 as a whole may have a front portion 45 connecting to the base frame 30, and a rear portion 46 connecting to the connecting end portion 11 of the belt strap 10. More specifically, the connector housing 40 may comprise a first housing member 41 and a second housing member 42 pivotally connected to the first housing member 41 at the rear portion 46 of the connector housing 40. The first housing member 41 and the second housing member 42 may be pivotally moved to toward and away from each other. The connector housing 40 may therefore be operated between a closed configuration and an opened configuration, wherein in the closed configuration, the second housing member 42 may be pivotally moved toward the first housing member 41 so as to form the connecting cavity 43 as a space enclosed by the first housing member 41 and the second housing member 42, and a connector opening 44 communicating the connecting cavity 43 with an exterior of the connector housing 40. The connector opening 44 may be formed at the rear portion 46 of the connector housing 40. In this preferred embodiment, the second housing member 42 may be positioned above the first housing member 41, so that when the connector housing 40 is in the closed configuration, the second housing member 42 may be pivotally moved to overlap on the first housing member 41. The closed configuration may be illustrated in FIG. 1 to FIG. 2 and FIG. 5 to FIG. 8 of the drawings.

On the other hand, when the connector housing 40 is in the opened configuration, the first housing member 41 and the second housing member 42 may be pivotally moved away from each other so as to expose the connecting cavity 43 from the front side 45 of the connector housing 40. The connector housing 40 may further comprise a plurality of holding pins 47 extended from the first housing member 41 at positions adjacent to the connector opening 44. Each of the holding pins 47 may upwardly extend from the first housing member 41 and may have top sharp tip 471 for contacting with the connecting end portion 11 of the belt strap 10. The opened configuration may be illustrated in FIG. 11 of the drawings.

The connector housing 40 may further comprise at least one locking latch 48 provided on the front portion 45 thereof, wherein the locking latch 48 may extend into and engage with the mounting slot 311 of the frame housing 31 for normally preventing the connector housing 40 from accidentally or undesirably turning into opened configuration. The locking latch 48 may be extended from one of the first housing member 41 and the second housing member 42 so that when the locking latch 48 is engaged with the mounting slot 311, the second housing member 42 is prevented from pivotally moving away from the first housing member 41 so as to retain the connector housing 40 in the closed configuration.

Figure 11:
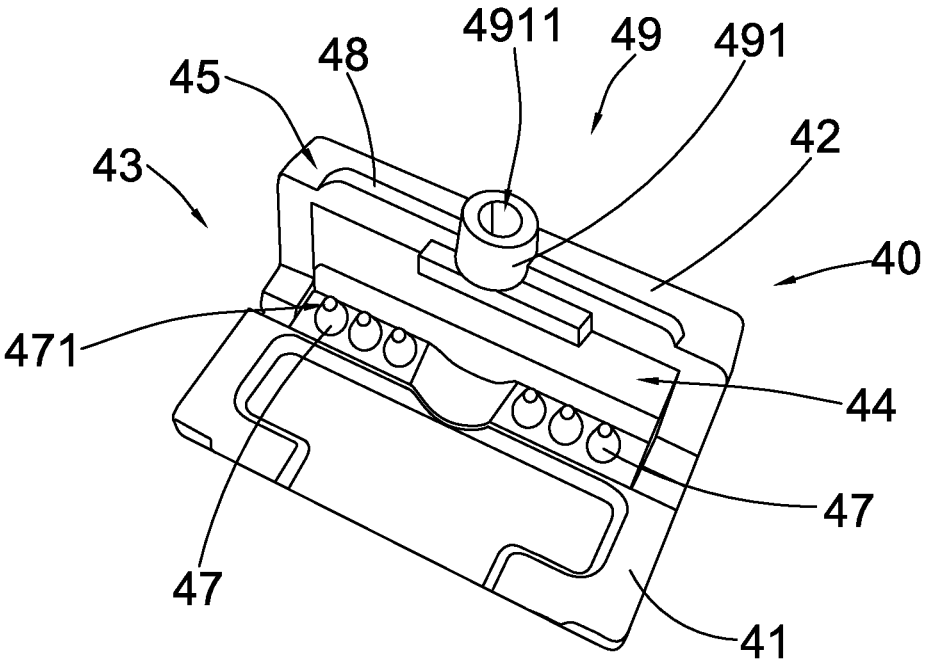
FIG. 11 is a schematic diagram of a connector housing of the belt buckle according to the preferred embodiment of the present invention, illustrating that the connector housing is in an opened configuration.

As shown in FIG. 9 and FIG. 11 of the drawings, the connector housing 40 may further comprise a coupling mechanism 49 extended therefrom for operatively coupling with the frame housing 31 of the base frame 30. The coupling mechanism 49 may comprise a tubular connector 491, a connector member 492, and a first resilient element 493 mounted on the connector member 492. The tubular connector 491 may extend from the front portion 45 of the connector housing 40 and may be arranged to be inserted into the through mounting hole 313 of the frame housing 31 in a rotatably movable manner. Thus, the connector housing 40 may rotate with respect to the base frame 30 about the tubular connector 491. Moreover, the tubular connector 491 may have a through coupling slot 4911 formed therein, in which the through coupling slot 4911 may extend between and communicate with the connecting cavity 43 and the through locking hole 316 via the through mounting hole 313.

The connector member 492 may comprise a connecting head 4921 and a connecting pin 4922 extended from the connecting head 4921. The connecting head 4921 may have a driving slot 4923 formed thereon for engaging with a screwdriver, so that the connector member 492 may be turned by the screwdriver through the driving slot 4923. On the other hand, the connecting pin 4922 may have an extension portion 4924 extended from the connecting head 4921, and a biasing free end portion 4925 arranged to penetrate through the through locking hole 316. Each of the connecting head 4921 and the extension portion 4924 may have a circular cross-sectional shape, in which a diameter of the extension portion 4924 is smaller than that of the connecting head 4921.

As shown in FIG. 9 and FIG. 10 of the drawings, the biasing free end portion 4925 may have a quadrilateral cross-sectional shape when viewed from the front. The biasing free end portion 4925 may have a height smaller than a diameter of the extension portion 4924, and a width larger than a diameter of the extension portion 4924. Furthermore, the width of the biasing free end portion 4925 may be larger than the height thereof. In this preferred embodiment, a width of the biasing free end portion 4925 may be smaller than that of the through locking hole 316 but may be larger than a maximum vertical height thereof. The first resilient element 493 may be configured as a compression spring and may be arranged to exert an urging force against the connecting head 4921.

The connection between the frame housing 31 and the connector housing 40 may be configured as follows: the first resilient element 493 may be mounted on the extension portion 4924 of the connecting pin 4922 of the connector member 492. The extension portion 4924 of the connecting pin 4922 may be arranged to penetrate through the through coupling slot 4911 of the tubular connector 491 and the mounting slot 311, while the biasing free end portion 4925 may also penetrate through the through coupling slot 4911, the mounting slot 311, and the through locking hole 316, so that the biasing free end portion 4925 may be exposed out of the frame housing 31 from the fastening portion 318 thereof. The connecting head 4921 may still be retained in the connecting cavity 43.

At the same time, the tubular connector 491 may be rotatably inserted in the through locking hole 316 until the locking latch 48 is engaged with the mounting slot 311. When the connector member 492 is inserted into the through locking hole 316, the biasing free end portion 4925 may be properly aligned with the through locking hole 316 (i.e. aligning with the curved top edge 3162 and the curved bottom edge 3163) so that biasing free end portion 4925 may be arranged to penetrate through the through locking hole 316.

In order to securely couple the connector housing 40 with the frame housing 31, the connector member 492 may be rotated at 90° such that the biasing free end portion 4925 may no longer be aligned with the through locking hole 316. In this position, the biasing free end portion 4925 may align with the vertical side edges 3161 of the through locking hole 316. The result is that the biasing free end portion 4925 may bias against a front biasing surface 319 of the frame housing 31 because a width of the biasing free end portion 4925 is larger than a maximum vertical height of the through locking hole 316. Due to the urging force exerted by the first resilient element 493, the connector housing 40 may normally be pulled toward the frame housing 31 and the connector housing 40 may be retained in the closed configuration.

When a user would like to turn the connector housing 40 into the opened configuration, he or she can pull the connector housing 40 away from the frame housing 31. Since the biasing free end portion 4925 is locked by the front biasing surface 319, pulling the connector housing 40 away from the frame housing 31 may extend the first resilient element 493 and allow the locking latch 48 to disengage from the mounting slot 311. When the locking latch 48 has disengaged from the mounting slot 311, the user may manually rotate the connector housing 40 and pivotally open the second housing member 42 from the first housing member 41. This turns the connector housing into the opened configuration.

When the user finishes opening the connecting cavity 43, he or she may pivotally move the second housing member 42 toward the first housing member 41 and turn the connector housing 40 back to the closed configuration. After that, the user may rotate the connector housing 40 until the connector housing 40 aligns with the frame housing 31 again. At this position, the first resilient element 493 may exert elastic urging force toward the connector housing 40 so as to force the connector housing 40 to move toward the frame housing 31 until the locking latch 48 re-engages with the mounting slot 311 again.

One skilled in the art may appreciate that by rotating the connector housing 40 with respect to the frame housing 31, one may selectively expose either one of the surfaces of the belt strap 10 to ambient environment so that the a wearer may selectively choose which side of the belt strap 10 to be used. In other words, the belt buckle of the present invention may allow dual use of the belt strap 10 in the sense that both sides of the belt strap 10 may be selectively exposed to an observer.

Figure 12:
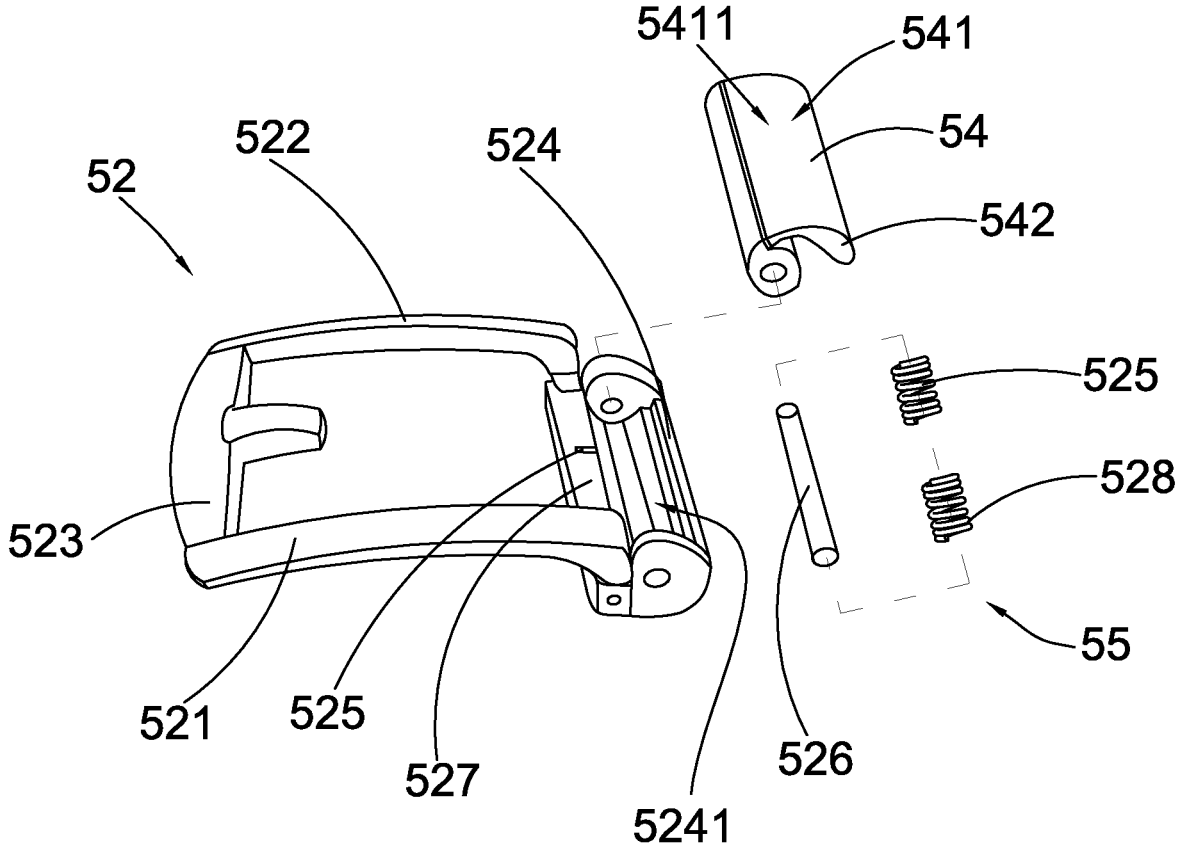
FIG. 12 is an exploded perspective view of the second fastening member of the belt buckle according to the preferred embodiment of the present invention.
Figure 13:
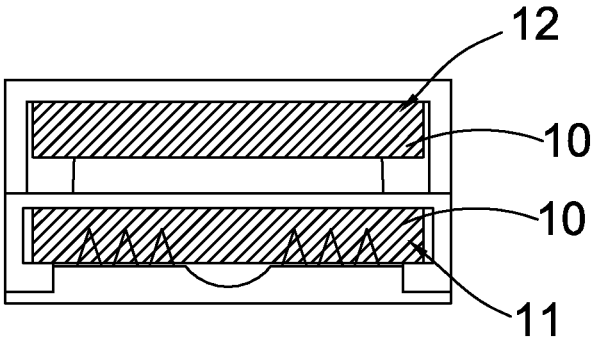
FIG. 13 is a schematic diagram of a belt with the belt buckle according to the preferred embodiment of the present invention.

Referring to FIG. 1. FIG. 9, FIG. 10 and FIG. 12 of the drawings, the first fastening member 51 may extend from the frame housing 31. More specifically, the first fastening member 51 may comprise a first longitudinal arm 511 and a second longitudinal arm 512 frontwardly extended from the extension members 32 respectively along a longitudinal direction of the belt buckle 20. Moreover, the first fastening member 51 may further comprise a first transverse arm 513 and a fourth transverse arm 514 extended between the first longitudinal arm 511 and the second longitudinal arm 512 along a transverse direction of the belt buckle 20. Thus, the first longitudinal arm 511, the second longitudinal arm 512, the first transverse arm 513 and the fourth transverse arm 514 may form a substantially rectangular structure of the first fastening member 51. Each of the first longitudinal arm 511 and the second longitudinal arm 512 may have a protruding portion 515 upwardly extending from the corresponding first longitudinal arm 511 or the second longitudinal arm 512. The first transverse arm 513 may extend between the two protruding portions 515.

On the other hand, the second fastening member 52 extend above the first fastening member 51. The second fastening member 52 may comprise a third longitudinal arm 521 and a fourth longitudinal arm 522 frontwardly extended from the base frame 30 along a longitudinal direction of the belt buckle 20. Moreover, the second fastening member 52 may further comprise a third transverse arm 523 and a second transverse arm 527 extended between the third longitudinal arm 521 and the fourth longitudinal arm 522 along a transverse direction of the belt buckle 20. The third longitudinal arm 521 and the fourth longitudinal arm 522 may be arranged and positioned to correspond to the positions of the first longitudinal arm 511 and the second longitudinal arm 512 respectively. Thus, when the second fastening member 52 is pivotally moved to overlap on the first fastening member 51, the protruding portions 55 may be arranged to bias against the third longitudinal arm 521 and the fourth longitudinal arm 522 respectively. The third transverse arm 523 may be positioned to correspond to the first transverse arm 513, while the second transverse arm 527 may be positioned to correspond to the fourth transverse arm 514.

Each of the third longitudinal arm 521 and the fourth longitudinal arm 522 may have an elongated curved structure so as to form the fastening slot 56 as a space enclosed by or within the first longitudinal arm 511, the second longitudinal arm 512, the third longitudinal arm 521 and the fourth longitudinal arm 522.

According to the preferred embodiment of the present invention, the second fastening member 52 may further comprise a pivot base 524 pivotally connected to the base frame 30, wherein the second transverse arm 527 may extend from the pivot base 524, while the third longitudinal arm 521 and the fourth longitudinal arm 522 may upwardly and frontwardly extend from the second transverse arm 527.

When the pivot base 524 pivotally moves with respect to the base frame 30, the second fastening member 52 as a whole may pivotally move with respect to the base frame 30 and toward and away from the first fastening member 51 as described above. The pivot base 524 may have an elongated structure and may be connected to and extend between the extension members 32 of the base frame 30 in a pivotally movable manner. In other words, the pivot base 524 may be accommodated in the accommodation cavity 33.

The holding bridge 53 may upwardly extend from the frame housing 311 of the base frame 30 so as to create the through securing slot 531 for allowing the fastening end portion 12 of the belt strap 10 to pass therethrough. Moreover, the through securing slot 531 may communicate with the fastening slot 56 so that the fastening end portion 12 of the belt strap 10 may first pass through the fastening slot 56 and then the through securing slot 531 when the belt is worn on the wearer's body. The holding bridge 53 may be configured as having a U-shaped cross-sectional shape when viewed from the front.

As shown in FIG. 12 of the drawings, the pivot base 524 may be shaped and sized to form a storage compartment 5241 for operatively receiving and supporting the biasing member 54. The resilient assembly 55 may comprise a second resilient element 525 provided in the storage compartment 5241 of the pivot base 524, and a pivot shaft 526 extended in the storage compartment 5241, wherein the second fastening member 52 may pivotally move with respect the first fastening member 51 about the pivot shaft 526. Thus, the pivot shaft 526 may be pivotally connected to the extension members 32 of the base frame 30 while the second resilient element 525 may be coupled to the pivot shaft 526. The second resilient element 525 may be arranged to bias against the second transverse arm 527 so as to normally retain the second fastening member 52 to bias against the first fastening member 51 at the protruding portions 515.

The resilient assembly 55 may further comprise a third resilient element 528 provided in the storage compartment 5241 of the pivot base 524 for exerting an urging force toward the biasing member 54. In this preferred embodiment, the third resilient element 528 may be coupled to the pivot shaft 526 at a position adjacent to the second resilient element 525. Each of the second resilient element 525 and the third resilient element 528 may be configured as a compression spring.

The biasing member 54 may comprise biasing portion 541 and two coupling portions 542 downwardly and spacedly extended from the biasing portion 541 to connect with the pivot shaft 526. The pivot shaft 526 may be arranged to penetrate through the coupling portions 542 of the biasing member 54 while the second resilient element 525 and the third resilient element 528 may be coupled to the pivot shaft 526 at a position between the two coupling portions 542. The biasing member 54 may be pivotally mounted to the second fastening member 52 in such a manner that the biasing member 54 may pivotally move with respect to the second fastening member 52. Furthermore, the third resilient element 528 may bias against the biasing portion 541 of the biasing member 54 so as to exert an urging force thereto. The biasing portion 541 may be configured as having a curved biasing surface 5411 which may be arranged to pivotally move to bias against the fastening end portion 12 of the belt strap 10 when the fastening end portion 12 pass through the through securing slot 531. The curved biasing surface 5411 may be made to have high frictional force so as to increase a grabbing force on the fastening end portion 12 of the belt strap 10.

From the above descriptions, one may appreciate that when the fastening end portion 12 may be fastened by the raid fastening arrangement 50, the fastening end portion 12 may be secured by the biasing force exerted between the protruding portions 515 and the second fastening member 52, and also by the biasing force exerted by the biasing member 54. As such, the fastening end portion 12 may be securely fastened to the belt buckle of the present invention so that the belt strap 10 may form a loop for fastening on the wearer's body. Furthermore, the connecting end portion 11 may also be secured in the connector housing 40. Therefore, no hole is required to be formed or punched on the belt strap 10. In connection with this feature, the belt buckle of the present invention may therefore allow rapid adjustment of a loop size of the belt strap 10 because a user may simply need to actuate the second fastening member 52 for fastening or loosening the belt strap 10 by adjusting the position of the fastening end portion 12.

Figure 14:
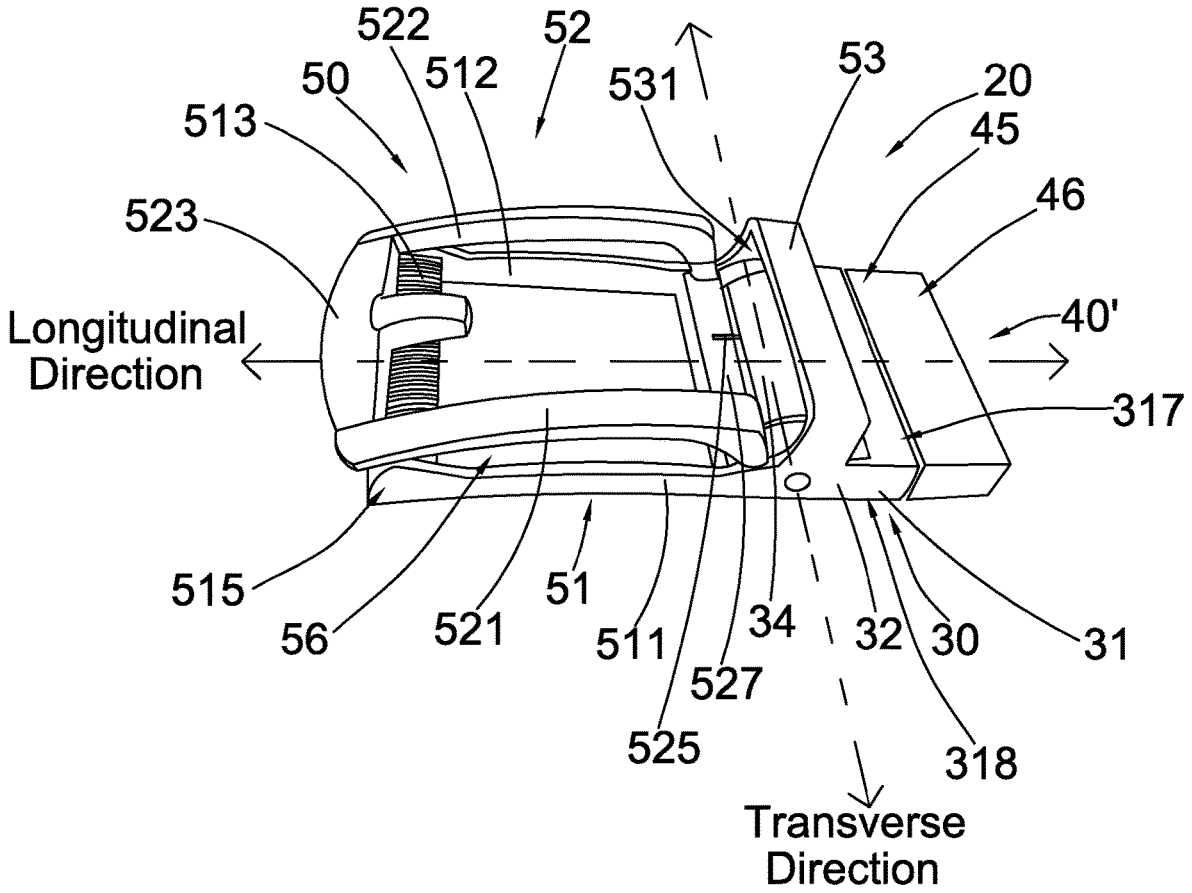
FIG. 14 is an alternative mode of the belt buckle according to the preferred embodiment of the present invention.
Figure 15:
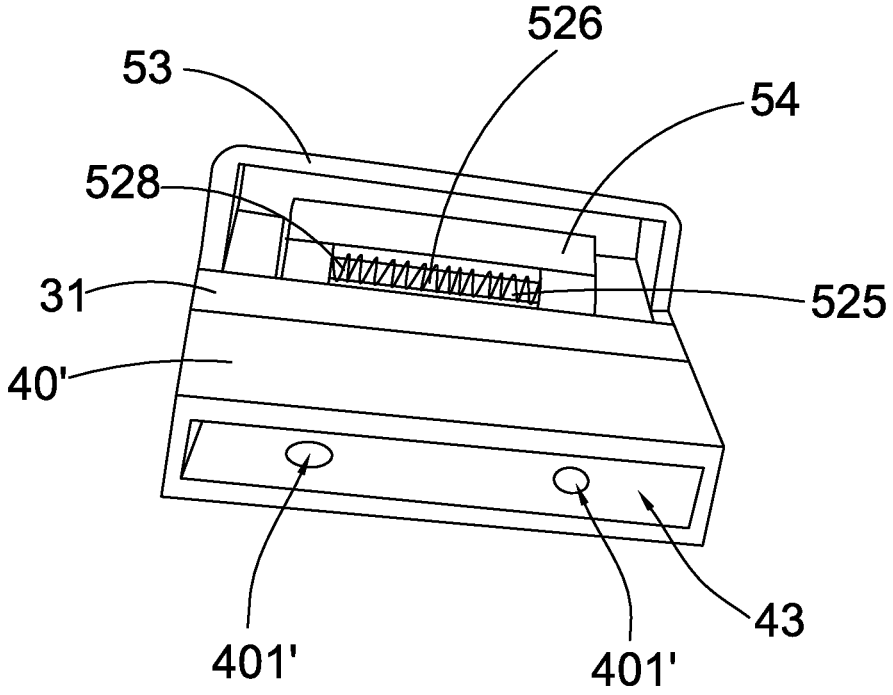
FIG. 15 is a schematic diagram of the alternative mode of the belt buckle according to the preferred embodiment of the present invention, illustrating an alternative configuration of the connector housing.
Figure 16:
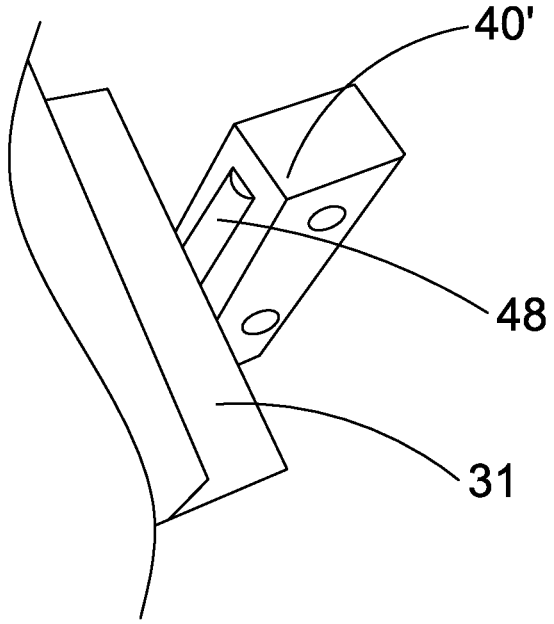
FIG. 16 is another schematic view of the belt buckle according to the alternative mode of the preferred embodiment of the present invention, illustrating that the connector housing is being rotated with respect to the base frame.

Referring to FIG. 14 to FIG. 16 of the drawings, an alternative mode of the belt buckle according to the preferred embodiment of the present invention as described above is illustrated. The alternative mode is similar to the preferred embodiment as described above, except the connector housing 40'. In the alternative mode, the connector housing 40' is an integral body and does not have the first housing member 41 and the second housing member 42, wherein the connecting cavity 43 is formed in his integral body. Moreover, the connector housing 40' does not have the holding pins 47. Rather, the connector housing 40' may have a plurality of securing holes 401' formed on the connector housing 40'. A wearer may connect the connecting end portion 11 of the belt strap 10 to the connector housing 40' through connecting screws the securing holes 401'.

Embodiments of the present disclosure, while illustrated and described in terms of disclosed embodiments and several alternatives, is not limited to the particular description contained in this specification. Additional alternative or equivalent components could also be used to practice embodiments of the present disclosure.

What is claimed is:

1. A belt buckle for a belt strap having a connecting end portion and a fastening end portion, comprising:

a base frame, which comprises a frame housing having a connecting portion and a fastening portion, and two extension members extended from said frame housing to form an accommodation cavity as a space between said two extension members;

a connector housing movably attached on said base frame, said connecting housing having a connecting cavity for detachably receiving said connecting end portion of said belt strap; and a rapid fastening arrangement, which comprises:

a first fastening member which is extended from said base frame, and comprises a first longitudinal arm and a second longitudinal arm frontwardly extended from said extension members respectively along a longitudinal direction of said belt buckle, said first fastening member further comprising a first transverse arm extended between said first longitudinal arm and said second longitudinal arm along a transverse direction of said belt buckle, each of said first longitudinal arm and said second longitudinal arm having a protruding portion upwardly extending from said corresponding first longitudinal arm and said second longitudinal arm;

a second fastening member extended from said base frame, at least one of said first fastening member and said second fastening member being arranged to be pivotally movable with respect to said base frame so as to form a fastening slot as a space between said first fastening member and said second fastening member for receiving said fastening end portion of said belt strap, said second fastening member comprising a third longitudinal arm and a fourth longitudinal arm frontwardly extended from said base frame along a longitudinal direction of said belt buckle, said second fastening member further comprising a second transverse arm extended between said third longitudinal arm and said fourth longitudinal arm along a transverse direction of said belt buckle, said third longitudinal arm and said fourth longitudinal arm being arranged and positioned to correspond to said first longitudinal arm and said second longitudinal arm respectively, so that when said second fastening member is pivotally moved to overlap on said first fastening member, said protruding portions is arranged to bias against said third longitudinal arm and said fourth longitudinal arm respectively;

a holding bridge extended from said base frame and having a through securing slot;

a biasing member pivotally supported in said through securing slot; and a resilient assembly mounted on said base frame and exert an urging force toward said biasing member, in such a manner that when said fastening end portion of said belt strap is received in said through securing slot, said resilient assembly is arranged to drive said biasing member, said first fastening member and said second fastening member to bias against said belt strap so as to securely fasten said fastening end portion on said belt strap.

2. The belt buckle, as recited in claim 1, wherein said second fastening member further comprises a pivot base pivotally connected to said base frame, wherein said second transverse arm extends from said pivot base, while said third longitudinal arm and said fourth longitudinal arm upwardly and frontwardly extend from said second transverse arm, so that when said pivot base pivotally moves with respect to said base frame, said second fastening member as a whole also pivotally moves with respect to said base frame and toward and away from said first fastening member.

3. The belt buckle, as recited in claim 2, wherein said pivot base further has a storage compartment, said resilient assembly comprising a second resilient element provided in said storage compartment of said pivot base, and a pivot shaft extended in said storage compartment, wherein said second fastening member is arranged to pivotally move with respect to said first fastening member about said pivot shaft, said pivot shaft pivotally connecting to said extension members of said frame housing while said second resilient element coupling to said pivot shaft, said second resilient element being arranged to bias against said second fastening member so as to retain said second fastening member to bias against said first fastening member at said protruding portions.

4. The belt buckle, as recited in claim 3, wherein said resilient assembly further comprises a third resilient element provided in said storage compartment of said pivot base and coupled to said pivot shaft, said biasing member comprising a biasing portion and two coupling portions downwardly and spacedly extended from said biasing portion to connect to said pivot shaft, said third resilient element being arranged to bias against said biasing portion of said biasing member so as to exert an urging force thereto for driving said biasing member to bias against said fastening end portion of said belt strap.

5. The belt buckle, as recited in claim 4, wherein said frame housing further having a mounting slot indently formed on said connecting portion of said frame housing along a transverse direction thereof, and surrounded by a curved boundary wall, wherein said connector housing is movably coupled to said connecting portion through said mounting slot, said frame housing further having a through mounting hole formed on said curved boundary wall of said mounting slot and extend along a longitudinal axis of said belt buckle.

6. The belt buckle, as recited in claim 5, wherein said frame housing has a front wall and a through locking hole formed on said front wall, said through locking hole extending along a longitudinal direction of said belt buckle communicating with said through mounting hole, said through locking hole being formed by two side edges, a curved top edge and a curved bottom edge, a maximum vertical height of said locking hole being smaller than a width thereof.

7. The belt buckle, as recited in claim 6, wherein said connector housing comprises a first housing member and a second housing member pivotally connected to said first housing member at a rear portion of said connector housing, said connector housing being operated between a closed configuration and an opened configuration, wherein in said closed configuration, said second housing member is pivotally moved toward said first housing member so as to form said connecting cavity as a space enclosed by said first housing member and said second housing member, wherein in said opened configuration, said first housing member and said second housing member is pivotally moved away from each other so as to expose said connecting cavity from a front side of said connector housing.

8. A belt buckle for a belt strap having a connecting end portion and a fastening end portion, comprising:

a base frame which comprises a frame housing having a connecting portion and a fastening portion, and two extension members extended from said frame housing to form an accommodation cavity as a space between said two extension members, said frame housing further having a mounting slot indently formed on said connecting portion of said frame housing along a transverse direction thereof and surrounded by a curved boundary wall, and a through mounting hole formed on said curved boundary wall of said mounting slot and extend along a longitudinal axis of said belt buckle, said frame housing further having a front wall and a through locking hole formed on said front wall, said through locking hole extending along a longitudinal direction of said belt buckle communicating with said through mounting hole, said through locking hole being formed by two side edges, a curved top edge and a curved bottom edge, a maximum vertical height of said locking hole being smaller than a width thereof;

a connector housing movably attached on said base frame, said connecting housing having a connecting cavity for detachably receiving said connecting end portion of said belt strap, said connector housing being movably coupled to said connecting portion through said mounting slot, said connector housing further comprising a first housing member and a second housing member pivotally connected to said first housing member at a rear portion of said connector housing, said connector housing being operated between a closed configuration and an opened configuration, wherein in said closed configuration, said second housing member is pivotally moved toward said first housing member so as to form said connecting cavity as a space enclosed by said first housing member and said second housing member, wherein in said opened configuration, said first housing member and said second housing member is pivotally moved away from each other so as to expose said connecting cavity from a front side of said connector housing, said connector housing further comprising at least one locking latch provided on said front portion thereof, wherein said locking latch extends into and engages with said mounting slot of said frame housing for normally preventing said second housing member from pivotally moving away from said first housing member so as to retain said connector housing in said closed configuration; and a rapid fastening arrangement, which comprises:

a first fastening member extended from said base frame;

a second fastening member extended from said base frame, at least one of said first fastening member and said second fastening member being arranged to be pivotally movable with respect to said base frame so as to form a fastening slot as a space between said first fastening member and said second fastening member for receiving said fastening end portion of said belt strap;

a holding bridge extended from said base frame and having a through securing slot;

a biasing member pivotally supported in said through securing slot; and a resilient assembly mounted on said base frame and exert an urging force toward said biasing member, in such a manner that when said fastening end portion of said belt strap is received in said through securing slot, said resilient assembly is arranged to drive said biasing member, said first fastening member and said second fastening member to bias against said belt strap so as to securely fasten said fastening end portion on said belt strap.

9. The belt buckle, as recited in claim 7, wherein said connector housing further comprises at least one locking latch provided on said front portion thereof, wherein said locking latch extends into and engages with said mounting slot of said frame housing for normally preventing said second housing member from pivotally moving away from said first housing member so as to retain said connector housing in said closed configuration.

10. The belt buckle, as recited in claim 8, wherein said connector housing further comprises a coupling mechanism extended therefrom for operatively coupling with said frame housing of said base frame, said coupling mechanism comprises a tubular connector, a connector member, and a first resilient element mounted on said connector member, said tubular connector extending from a front portion of said connector housing and being arranged to be inserted into said through mounting hole of said frame housing in a rotatably movable manner, said tubular connector having a through coupling slot extending between and communicating with said connecting cavity and said through locking hole via said through mounting hole.

11. The belt buckle, as recited in claim 9, wherein said connector housing further comprises a coupling mechanism extended therefrom for operatively coupling with said frame housing of said base frame, said coupling mechanism comprises a tubular connector, a connector member, and a first resilient element mounted on said connector member, said tubular connector extending from a front portion of said connector housing and being arranged to be inserted into said through mounting hole of said frame housing in a rotatably movable manner, said tubular connector having a through coupling slot extending between and communicating with said connecting cavity and said through locking hole via said through mounting hole.

12. The belt buckle, as recited in claim 10, wherein said connector member comprises a connecting head and a connecting pin extended from said connecting head, said connecting pin having an extension portion extended from said connecting head, and a biasing free end portion arranged to penetrate through said through locking hole.

13. The belt buckle, as recited in claim 11, wherein said connector member comprises a connecting head and a connecting pin extended from said connecting head, said connecting pin having an extension portion extended from said connecting head, and a biasing free end portion arranged to penetrate through said through locking hole.

14. The belt buckle, as recited in claim 12, wherein said biasing free end portion has a height smaller than a diameter of said extension portion, and a width larger than a diameter of said extension portion, said width of said biasing free end portion being smaller than that of said through locking hole but larger than a maximum vertical height thereof.

* * * * *